US005508070A

United States Patent [19]

DiLapo et al.

[11] Patent Number: 5,508,070

[45] Date of Patent: Apr. 16, 1996

[54] MAGNETIC FLOWER AND PROCESS

[75] Inventors: Melissa B. DiLapo, Elma; Thomas J. Pompeo, Cheektowaga, both of N.Y.

[73] Assignee: Carnets, Inc., Depew, N.Y.

[21] Appl. No.: 420,585

[22] Filed: Apr. 11, 1995

[51] Int. Cl.[6] ..... A41G 1/00

[52] U.S. Cl. ..... 428/24; 428/99; 428/900; 156/61

[58] Field of Search ..... 428/24, 99, 900; 156/61

*Primary Examiner*—Alexander S. Thomas

*Attorney, Agent, or Firm*—James J. Ralabate

[57] ABSTRACT

This invention provides an artificial flower that can be magnetically attached to a car or any other metallic surface. The flower has a hollow conduit that fits into central openings in flower corollas and into which a stem fits. At the bottom of the stem is attached a downwardly facing cup that contains an extending magnet fixed in place by an adhesive. When the flower is assembled its components are locked in place by a resilient locking head which is pushed through and extends beyond the end of the conduit when in its locked position.

16 Claims, 1 Drawing Sheet

MAGNETIC FLOWER AND PROCESS

This invention relates to an artificial flower construction and, more specifically, to an artificial flower having a magnetic base portion.

BACKGROUND OF THE INVENTION

It is known to make artificial plants and flowers using a plurality of construction materials such as plastics, silk, paper, fabric or the like. In plants the components generally are of the same material since most plants are green and have similar color stems and leaf sections. Artificial flowers, on the other hand, usually have plastic stems which are often colored green and petal sections which can be several colors such as white, red, yellow, etc. These petal sections generally are separate foils or silk colored and shaped sheets that are attached together to simulate a natural flower. The resulting flowers are used as are natural flowers to fit into vases, to decorate centerpieces, to decorate cars or floats and the like. There are various structures of artificial flowers that have been used and known in the prior art. Some of these are described in U.S. Pat. Nos. 3,088,295; 3,574,901; 4,835,024; 5,120,583 and 5,281,452. In 3,088,295 (Haines), a structure is described where a rivet is inserted through a hole in a leaf or petal to form a flower. The fastening element used in Haines is a male element of a snap fastener. This type prior art device has limited use such as clothing where snap fasteners are used. In U.S. Pat. No. 3,574,901 (Nogue) a fastener for flower ornaments is disclosed where the ornaments are attached to bathing caps or the like. This prior art reference teaches slipping the petals of a flower over the stem until the flower arrangement is accomplished. Each petal is slipped over the tapered top of Nogue's device. The bottom of Nogue's structure is a disc-shaped flange which would fit into a cavity of the device to be decorated. Nogue's device as is Hanies' device must be used as a structure with a corresponding mating element, i.e. Haines with a female snap fastneet and Nogue with a cavity into which the disc-shaped flange is positioned. Without these mating elements on the item to be decorated, these prior art flower structures cannot be used. In Hallay, U.S. Pat. No. 4,835,024, a flower structure with a metallic base is disclosed. The metallic base of Hallay is made from a flexible magnetic sheet material which generally causes a suction to develop as the base is removed from the decorated item. To reduce or eliminate any suction between the base and the magnetizable surface of the decorated article an aperture must be located in the base of the flower. Also, Hallay uses a projection member 24 and a sleeve 30 that fits over the projection member to form a fastener for the ornamental flower. The projection member 24 has an end 34 which is fitted and melted over the sleeve 30 to retain all elements in position. This melting step is somewhat complex once the petals are in position and represents a vulnerable step in the production of flowers of this type. In lieu of melting, an adhesive may be used to hold sleeve 30 and projection member 24–34 together. Again, this represents a somewhat tedious procedure step in the manufacturing process. A more simplified, more efficient procedure to lock all of the components of a flower ornament together would be highly desirable.

In Garcia, U.S. Pat. No. 5,120,583, a composite flower assembly is disclosed having a preserved natural flower head securely fastened atop an artificial calyx. An eyelet 57 and ball of thread 58 are received within a hollow tubular coupling member 61 and glued to an artificial calyx 66. A glob of glue 69 is used to lock all components together as described and illustrated by Garcia. Again, the use of glue, melt and/or calyx to attach components together can be complex, of limited effectiveness and time consuming. A mechanical locking means that effectively secures all member components easily and inexpensively would be very desirable.

U.S. Pat. No. 5,281,452 (Cheng) discloses an artificial flower made from a stack of juxtaposed petal members having radially-extending petals. The petals are then connected together by a common string or rope or by being wrapped together by tape or stapled together with a common staple. The assembly process of Cheng requires tiling, pasting or stapling each petal to the other to form the composite structure. This can be a cumbersome and time-consuming manufacturing process.

In all of the above-discussed prior art, there is no artificial flower structure having a simple locking means that fixes all flower components easily and effectively. Also, there is no structure in the prior art where the main flower components are all non-magnetic and wherein a separate magnet is easily attached thereto. In a flexible magnetized base portion, the problem of suction must be dealt with whereas in the present invention no such drawback is encountered.

While many of these artificial flowers can be used to decorate cars and floats, most require the use of adhesives or tapes in order to attach the flowers to the structure to be decorated. Once the parade or wedding is over with, these flowers are removed and generally discarded since they are damaged when removed from the car or float surface. Also, the car surface requires cleaning to remove the adhesive or tape used to attach the flower. In addition to a time-consuming taping or gluing of the flower to the car, the disposing of the flowers used can become relatively expensive since artificial flowers are generally not inexpensive. Thus, there is a need for a simple attachment manner of connecting flowers to floats, cars, etc. while providing flowers that can be reused over and over with the same or similar decorative appearance.

SUMMARY OF THE INVENTION

It is therefore an object of this invention to provide a decorative flower structure devoid of the above-noted disadvantages.

Another object of this invention is to provide a flower attachment means that does not become destroyed or diminished after several uses.

Still another object of this invention is to provide a process for making an artificial decorative flower that is easy, economical and effective.

Yet another object of this invention is to provide a reusable artificial flower that securely attaches to metal surface structures without being easily dislodged by moving structures such as cars, trucks, floats and the like.

Another still further object of this invention is to provide a novel structure and process adapted for economical usage by the customer-user.

These and other objects are accomplished, generally speaking, by a flower structure and process comprising at least a four-component product.

The first component has a downward-facing cup housing to contain and hold a magnet in place. While the drawings and description herein define a circular structure or cup housing, any shape that is suitable can be used. The upper surface of the downward-facing cup has extending upwardly therefrom an elongated stem section that terminates at its uppermost portion into a locking head. The locking head will be referred throughout as "mushroom-like"; this is to mean the locking head structure as shown in the drawings or similar thereto. Any other type head such as arrow-like may also be used but the type illustrated in the drawings is preferred. This stem section will also be referred to herein as the male portion of the petal locking means. This first component can be constructed of plastic, plexiglass or paper or any other substantially non-magnetic material. The terms "upwardly" and "downward" or other directional terms are determined and defined as when the flower unit in its entirety is placed on a flat horizontal surface with the cup opening in resting contact with the supporting horizontal surface as shown below in FIG. 4.

The second component of this invention comprises a tubular conduit open at both terminal ends into which the stem section fits and mates. This second component is generally made of resilient plastic but can be constructed of rubber, paper or other somewhat flexible material. A flexible or resilient material is critical to this invention since the locking head of the stem portion of the first component is slightly larger in diameter than the diameter of the tubular conduit. This is required since the locking head will be pushed into and when completely pushed through the tubular conduit, it will exit and fit over the upper terminal portion of the tubular conduit in a locking fashion similar in some respects to an arrowhead thus locking the entire first component to the tubular conduit. As noted earlier, any suitable materials may be used for the first and second components. Plastics are preferred because they are somewhat resilient and are easy to handle. Suitable plastics or polymers include materials containing polyamides, polystyrene, polycarbonates, polyvinylchlorides, polyurethanes, polyethylenes, and mixtures thereof. Also, rubber or other suitable compositions may be used, if desirable.

The third component of this invention is the plurality of petal sections (the corolla) that make up the flower-like decorative part of the structure. These petal sections can be easily secured together since each has a central aperture through which the tubular conduit snuggly fits. After the tubular conduit is extended through these apertures, the first component with its extending stem section is pushed through the tubular conduit with the locking head extending beyond the upper tubular conduit terminal to lock the second and third components in position. This third component or petal section can be constructed of paper products, plastics, silk, materials both natural and synthetic and mixtures thereof. These petal sections are secured together and arranged so that they simulate the petal portion of a natural flower. Any type artificial flower can be used in the present invention.

The fourth and last component of this invention is the magnet that fits into the cup of the first component and is secured therein by the use of any suitable adhesive. The magnet extends beyond the lower wall portions of the cup so that they can easily make contact with the metal structure being decorated such as the exterior of a car. The magnet can be of any size or shape as long as it conforms to the cup into which it will fit and be secured. Any conventional magnet may be used in the present structure. Suitable magnets are of the type obtained from Magnet Sales and Manufacturing, Inc., 11248 Playa Court, Culver City, Calif. 90230.

DETAILED DESCRIPTION OF THE DRAWING AND THE PREFERRED EMBODIMENTS

Figure 1:
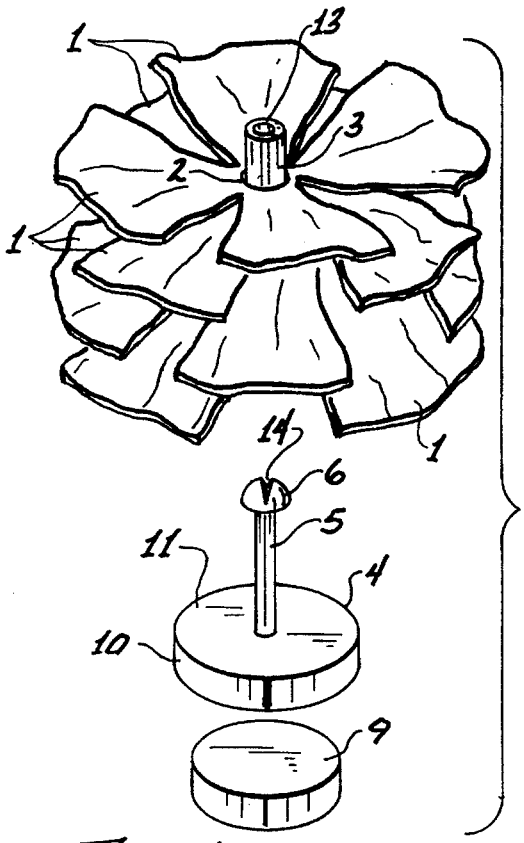
FIG. 1 is an exploded perspective view showing the four essential components of the present invention.

In FIG. 1 petals 1 which are the segments 1 of the corolla of a flower, are shown in a detached view separated one from the other. In actual configuration, a plurality of petals is used to complete the corolla in the artificial flower. Each petal segment has a central aperture 2 so that when aligned the tubular conduit 3 can be tightly inserted therethrough holding all of the segments 1 together. The cup housing 4 with a vertically extending stem 5 is then inserted through said tubular conduit 3 and pushed through until the locking head 6 extends out from the upper terminal end of said conduit 3. Conduit 3 is open on both ends 7 and 8 to permit stem 5 to be pushed into and through its entire length. The diameter of resilient conduit tube 3 is slightly smaller than the diameter of locking head 6 but, because it is resilient, it allows locking head 6 to be pushed therethrough. Once it reaches terminal end 7 it exits and extends outwardly therefrom and, because of its mushroom-like configuration, will lock the cup unit 4 in place. Locking head 6 may be of any suitable construction so long as it has an expanded (normal mode) form diameter greater than the diameter of tubular conduit 3. There must be contracting means 14 in locking head 6 to permit it to contract for passage through conduit 3, but contracting means 14 must be capable of expanding when exiting conduit 3 so that it will lock stem 5 into conduit 3 by its overhang expanded section. In the FIGS. 1–5 locking head 6 is shown with a v-shaped slot 14 as the preferred contracting means. The term "normally" used in the disclosure and claims when defining locking head 6 means in its expanded non-contracted mode; ie., when not in constricted or contracted shape as in passage through conduit 3. Means 14 allow locking head 6 to expand and contract.

While locking head 6 is shown as a mushroom-like configuration, any locking head with a gap or gaps that permits contraction and expansion during use is within the spirit of this invention and included herewith.

The length of stem 5 is slightly longer than the length of tubular conduit 3 to allow lock head 6 to extend beyond terminal section 7 of conduit 3 and lock all petal segments 1 and tubular conduit 3 in place. The magnet 9 is then secured in cup 4 by an adhesive. The height of magnet 9 is slightly more than the height of cup walls 10 so that the magnet 9 will extend beyond the walls 10 for easy contact with a metallic surface to be decorated.

Figure 2:
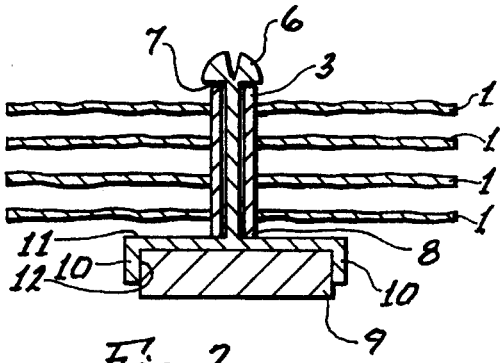
FIG. 2 is an assembled flower structure having all components secured in place.

In FIG. 2 the assembled structure of this invention is illustrated with all components in place. Petal segments 1 are combined and secured around tubular conduit 3 to form the corolla portion of this assemblage. Stem 5 is secured inside conduit 3 and locking head 6 overhangs terminal section 7 and locks with conduit 3. Magnet 9 may be secured within cup 4 either before or after stem 5 is pushed through conduit 3. As earlier noted, magnet 9 extends out from cup 4 so that it rather than non-magnetic cup 4 contacts the metallic surface to be decorated. Any number or shape of petal segments 1 may be used depending on the type flower desired. Various flowers such as carnations, roses or chrysanthemums. May be simulated in the structure and process of this invention. Stem 5 extends from the roof 11 of cup 4 so that the lower last petal segments 1 will rest upon roof 11 and be forced in place by the wedging action of roof 11 with lock head 6. Thus, the corolla (combination of segments 1) is sandwiched between the roof 11 and the lock head 6.

Figure 3:
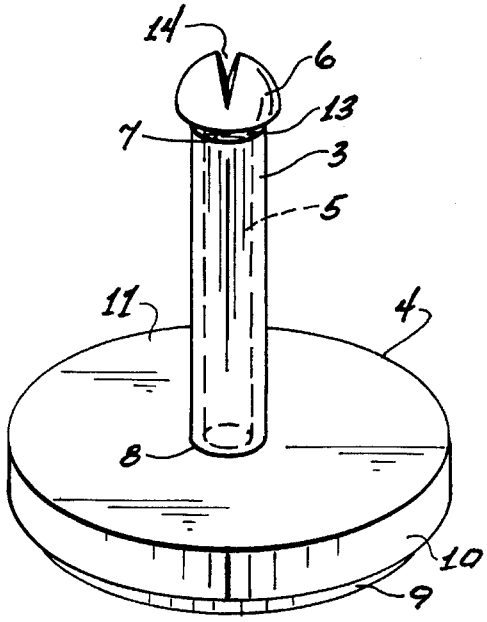
FIG. 3 is a plan view of the cup component with its upwardly and vertically extending stem.

FIG. 3 is a perspective side view of the cup housing 4 having stem 5 extending vertically substantially perpendicular to cup roof section 11. Since the cup opening 12 faces downward it is necessary that an adhesive be used in the interior of walls 10 and roof 11 to secure magnet 9 therein. If the walls 10 surrounding the cup opening 12 are 3/16 of an inch high, the magnet to be placed therein will have a height of about 4/16 of an inch. The difference between the diameter of stem 5 from the wider diameter of head lock 6 should be approximately equal to or greater than the thickness of the wall 13 of tubular conduit 3. The head lock 6 is somewhat resilient or has contracting means 14 so that it will expand upon exiting from conduit 3 where it was somewhat constricted during its passthrough of conduit 3. In FIG. 3 cup housing structure 4 is shown (without petals 1 for clarity) after it is inserted through tubular conduit 3 and is resting on a horizontal supporting surface or roof 11. In this figure it can be seen how lock head 6 extends out from terminal end 7 of conduit 3 to lock structure 4 with conduit 3. Magnet 9 is shown as it slightly extends beyond the walls 10 of cup structure 4. When the petals as in FIG. 2 are on the structure, the top face of the uppermost petal 1 or petals 1 contacts and is held in place by lock head 6, whereas the lowermost petal 1 or petals 1 are contacted by and held in place by the roof section 11 of cup structure 4.

Figure 4:
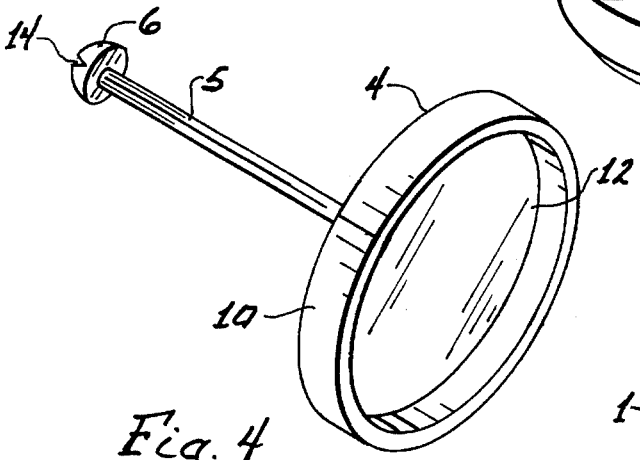
FIG. 4 is a plan view of the magnet-containing cup component with its stem as it is inserted into and locked with the tubular conduit.

In FIG. 4 a bottom perspective view of the cup structure 4 is shown. The cup opening 12 is shown without the magnet 9 attached thereto. Walls 10 of the cup structure 4 together with an adhesive will hold magnet 9 in place when the structure is completed. Cup structure 4 has a stem 5 as shown in the other figures extending vertically (at 90° angle from roof 11) upward for locking with conduit 3 and the surrounding petals 1.

Figure 5:
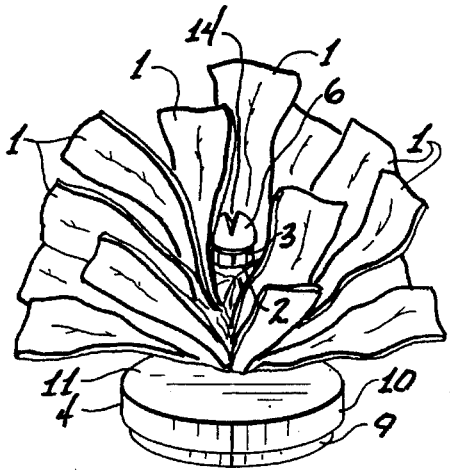
FIG. 5 is a bottom perspective view of the cup component without the magnet secured therein.

In FIG. 5 the assembled flower structure is illustrated with all components fixed in place. Magnet 9 is secured within opening 12 of cup structure 4. Stem 5 is inserted into conduit 3 with lock head 6 extending outwardly therefrom to lock all components to the petals 1.

The preferred and optimally preferred embodiments of the present invention have been described herein and shown in the accompanying drawings to illustrate the underlying principles of the invention but it is to be understood that numerous modifications and ramifications may be made without departing from the spirit and scope of this invention.

What is claimed is:

1. An artificial flower structure comprising in combination a plurality of petal units, a tubular conduit, a cup housing and a magnet, said petal units having centrally positioned apertures each aligned with the other when superimposed and stacked, said tubular conduit having a hollow portion throughout its entire length, said tubular conduit adapted to fit tightly through each and all of said centrally positioned apertures, said cup housing having a downward facing cup opening with its closed roof portion facing upward, extending perpendicularly from said roof portion is a stem which terminates at its uppermost portion into a locking head, said stem having a diameter smaller than a diameter of said hollow portion of said conduit, said locking head normally having a larger diameter than both said tubular conduit and said stem, said stem positioned into said tubular conduit while said petal units are encircled around and in contact with said conduit.

2. The flower structure of claim 1 wherein said locking head has means to provide said locking head to expand and contract.

3. The flower structure of claim 1 wherein said locking head extends beyond an upper terminal portion of said tubular conduit.

4. The flower structure of claim 1 wherein said stem has a length greater than the length of said tubular conduit.

5. The flower structure of claim 1 wherein said apertures of said petal units are slightly larger in diameter than the diameter of said tubular conduit.

6. The flower structure of claim 1 wherein said magnet is positioned in and secured to said downward facing cup opening and extending outwardly therefrom.

7. The flower structure of claim 1 wherein said petal units are constructed from a material selected from the group consisting of silk, paper products, plastics, synthetic fabrics, natural fabrics and mixtures thereof.

8. The flower structure of claim 1 wherein said cup housing and said tubular conduit are constructed from a non-magnetic material.

9. A process for constructing an artificial flower which comprises providing a plurality of centrally apertured petal units, a hollow resilient tubular conduit, a cup housing, said cup housing having an upwardly extending stem positioned thereon, and a magnet, positioning said petal units so that their apertures are all in alignment, pushing said hollow tubular conduit through all of the apertures of said petal units to form thereby a flower corolla, fitting and securing said magnet to a downwardly facing opening in said cup housing in a manner so that at least a portion of said magnet extends beyond the depth of said downward facing opening, inserting and pushing said upwardly extending stem through said hollow tubular conduit to lock therein, and fluffing and arranging said flower corolla to simulate a corolla of a natural flower.

10. The process of claim 9 wherein said magnet is secured to said cup housing prior to inserting said upwardly extending stem through said hollow tubular conduit.

11. The process of claim 9 wherein said magnet is secured to said cup housing subsequent to inserting said upwardly extending stem through said hollow tubular conduit.

12. The process of claim 9 wherein said stem has a terminal locking head portion having means to expand and contract.

13. The process of claim 9 wherein said stem has a length greater than the length of said hollow tubular conduit.

14. The process of claim 9 wherein said apertures of said petal units are slightly larger in diameter than the diameter of said tubular conduit.

15. The process of claim 9 wherein said petal units are constructed from a material selected from the group consisting of silk, paper products, plastics, synthetic fabrics, natural fabrics and mixtures thereof.

16. The process of claim 9 wherein said cup housing and said tubular conduit are constructed from a non-magnetic material.

* * * * *